US005274881A

United States Patent [19]

DeRosa

[11] Patent Number: 5,274,881

[45] Date of Patent: Jan. 4, 1994

[54] LATCHING HINGE

[76] Inventor: Frank DeRosa, 4815 W. 121st Pl., Alsip, Ill. 60658

[21] Appl. No.: 944,224

[22] Filed: Sep. 14, 1992

[51] Int. Cl.[5] ..... E05D 15/50

[52] U.S. Cl. ..... 16/230; 16/231; 49/381

[58] Field of Search ..... 16/230, 229, 231, 232, 16/254, 255, 262; 49/381, 395

[56] References Cited

U.S. PATENT DOCUMENTS

| | | | |
|---|---|---|---|
| 1,021,885 | 4/1912 | Peterson | 16/229 |
| 1,024,837 | 4/1912 | DuPuis | 16/230 |
| 1,910,102 | 5/1933 | Godfrey | 16/230 |
| 2,186,789 | 1/1940 | Rosenberg | 16/229 |
| 2,249,329 | 7/1941 | Rosenberg | 16/229 |

*Primary Examiner*—Richard K. Seidel
*Assistant Examiner*—Chuck Y. Mah
*Attorney, Agent, or Firm*—Kinzer, Plyer, Dorn, McEachran & Jambor

[57] ABSTRACT

A hinge for removably attaching a cover member to a container member. The hinge includes a first plate affixable to one of the members and a second plate affixable to the other of the members. A first tubular socket is formed integrally with the first plate and a second tubular socket is formed integrally with the second plate. The first and second tubular sockets are aligned when the first and second plates are affixed in alignment to the container and cover members. A J-shaped rod is formed with a longer leg and a shorter leg joined by a integral bail. A cap is formed on the end of the longer leg which is located away from the bail. The J-shaped rod is mounted on the first plate with its longer leg extending through the first tubular socket. A coil spring telescopes over a portion of the longer leg of the J-shaped rod with the spring engaging the first tubular socket and the cap to bias the bail against the opposite side of the first tubular socket and to seat the shorter leg in the second tubular socket. The shorter leg is movable in and out of the second tubular socket to latch the plates together or to function as a hinge permitting rotation of one plate relative to the other plate.

3 Claims, 2 Drawing Sheets

LATCHING HINGE

BACKGROUND AND SUMMARY OF THE INVENTION

The invention is concerned with a removable hinge mechanism which also functions as a latch to facilitate the opening of shipping containers without damaging the containers. Products and other materials sent to trade shows and exhibitions are usually shipped in containers which have covers or sides which are nailed or otherwise fastened shut to prevent loss of the products and materials during shipping. Sometimes hinges are applied to all four corners of a cover or a removable panel to secure the cover or panel in place. Two of the hinges must be removed to swing open the cover or all four can be removed to lift off the cover. Upon arrival at the show or exhibition, the containers are opened by removal of the nails or fastening means holding the hinges in place through the use of claw hammers, crowbars or other tools. For example, it is sometimes necessary to engage the services of a workman to unscrew the hinges to remove the cover or panel of a container. Many times the shipping containers are damaged by the opening procedure, sometimes s severely that the containers must be either extensively repaired or scrapped.

An object of this invention is a hinge for a container such as a shipping container that also functions as a latching mechanism so that the container can be opened without the use of claw hammers, crowbars or other tools.

Another object of this invention is a latching hinge for a container which hinge can be disassembled without the danger of losing or misplacing the parts of the hinge.

Another object of this invention is a latching hinge which is securely held in a closed position but can be easily opened by the application of a suitably directed force.

Another object of this invention is a latching hinge which is sufficiently strong to function properly under adverse conditions.

Other objects may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figure 1:
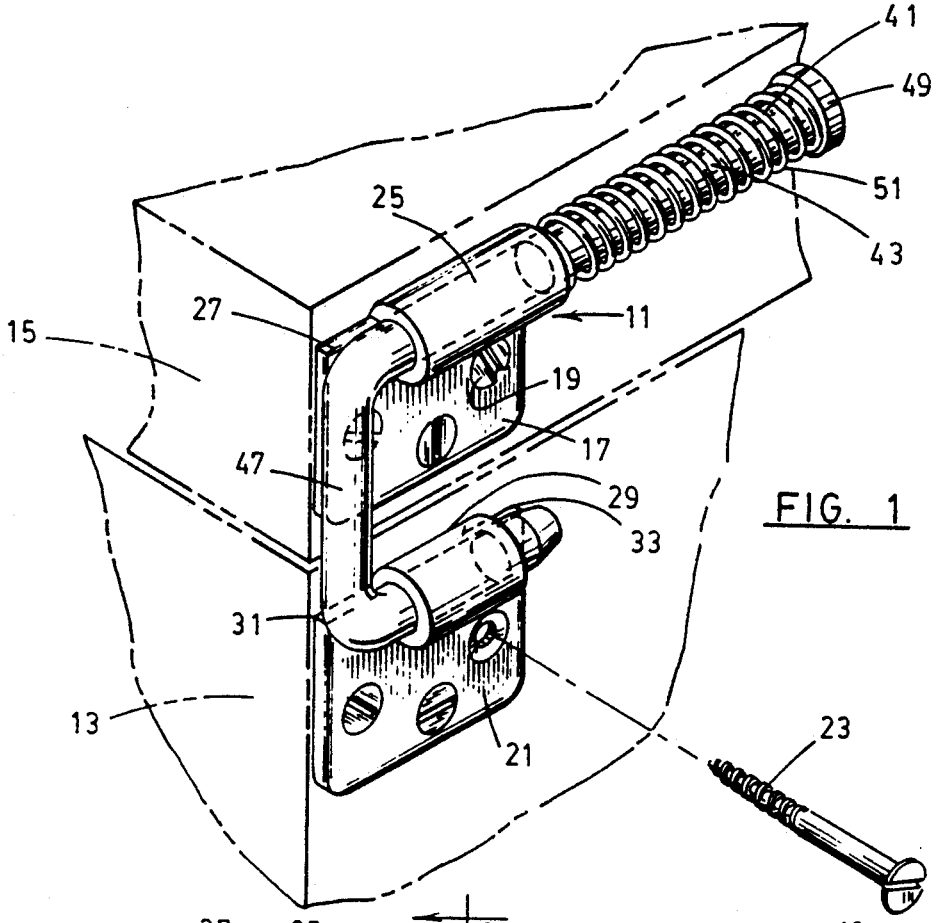
FIG. 1 is a perspective view of a latching hinge of this invention mounted on a shipping container which is shown in phantom lines.

FIG. 1 of the drawings shows a latch hinge 11 constructed in accordance with the teachings of this invention and mounted on a container 13 having a cover 15. In this specification, the word "cover" is intended to include not only a conventional cover which one would expect to find on the top of a container but also includes any panel or portion of a wall of a container which may be removed to gain access to the contents of the container. The latch hinge 11 includes a first plate 17 which is fastened to the cover 15 by screws 19 and a second plate 21 which is fastened to the container 13 by screws 23, one of which is shown in a removed position. The first plate 17 includes a first tubular socket 25. The tubular socket 25 is formed integrally with the plate 17 by rolling a portion of the plate back upon itself after another portion of the plate is notched away as shown at 27. Thus, the length of the tubular socket is less than the width of the plate 17. A second tubular socket 29 is formed integrally with the second plate 21 also by rolling an end of the plate back upon itself to form the socket after notches 31 and 33 are cut from the plate. Thus, the second tubular socket 29 is considerably shorter than the width of the plate 21 and is located in the middle of an edge of the second plate.

The first and second tubular sockets 25 and 29 are connected by a J-shaped rod 41 which is formed with a longer leg 43 and a shorter leg 45. The legs are connected by a bail 47 formed integrally therewith. The J-shaped rod 41 is supported on the first plate 17 with its longer leg 43 rotatably and slidably mounted in the first tubular socket 25. A cap 49 is formed at the end of the longer leg 43 which is located opposite to the bail 47. Since neither the cap 49 nor the bail 47 can pass through the first tubular socket 25, the J-shaped rod cannot be removed from this socket. A coil spring 51 telescopes over the longer leg 43 and engages the end of the first tubular socket 25 and the cap 49 to bias the bail 47 of the J-shaped rod up against the first tubular socket 25. The shorter leg 45 of the J-shaped rod 41 fits into the second tubular socket 29 of the second plate 21 to function both as a latch to connect the two plates 17 and 21 together and as an axle to allow rotation of the first plate 17 relative to the second plate 21 when the latch hinge 11 functions as a hinge.

Figure 2:
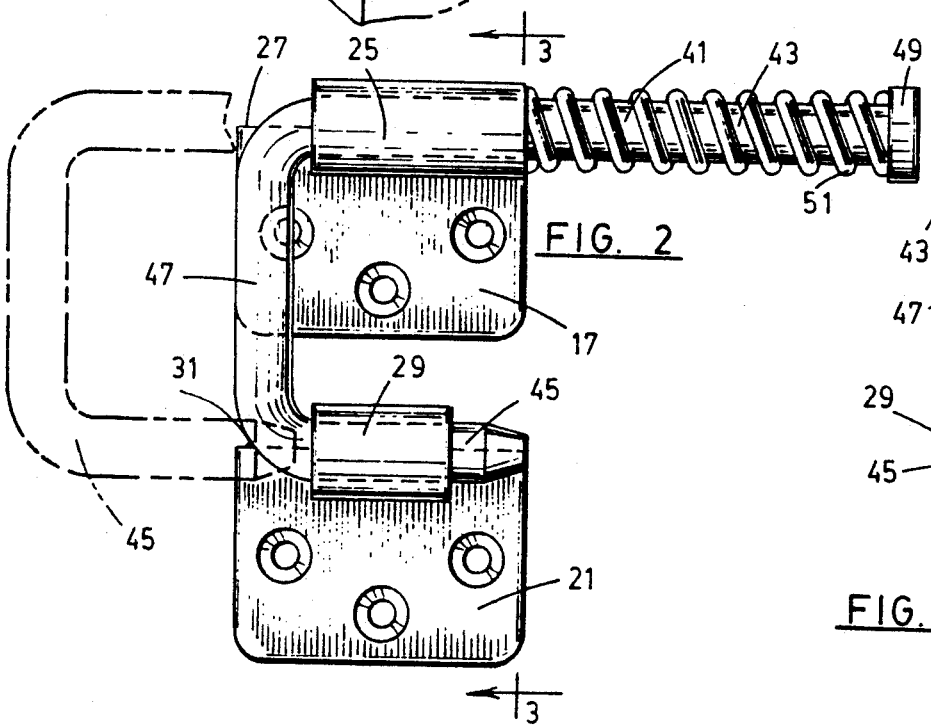
FIG. 2 is a front elevational view of the hinge of FIG. 1 showing a disconnected position of the hinge in phantom lines.
Figure 3:
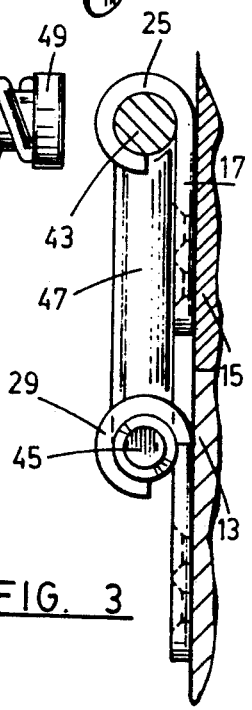
FIG. 3 is a cross sectional view taken along line 3—3 of FIG. 2.

In order to separate the plates 17 and 21 of the hinge so that the cover 15 may be removed from the container 13, the longer leg 43 of the J-shaped rod 41 is pushed to the left as shown in FIGS. 1 and 2 of the drawings by applying a force to the cap 41, thus compressing the coil spring 51. As the longer leg 43 moves to the left, the shorter leg 45 of the J-shaped rod is moved out of the second tubular socket 29 of the second plate 21 thereby releasing the first plate 17 from engagement with the second plate 21.

Figures 4, 5:
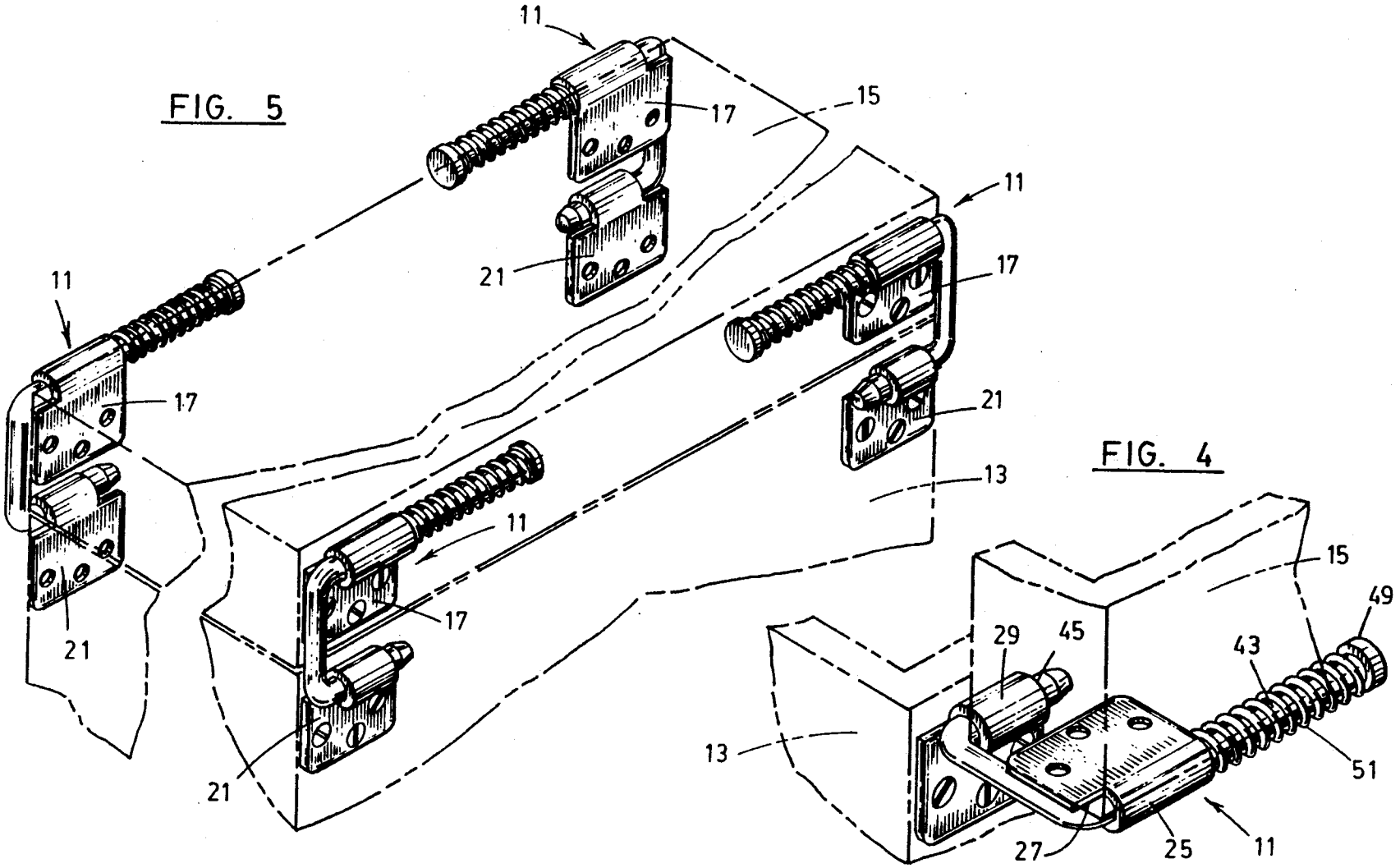
FIG. 4 is a perspective view of a hinge of this invention shown in a cover open position with the invention functioning as a hinge and with the container and cover shown in phantom line.
FIG. 5 is a perspective view showing four hinges of this invention mounted on a cover and container with the shipping container and cover shown in phantom lines.

When the latch hinge 11 functions as a hinge in the manner shown in FIG. 4 of the drawings, wherein the cover 15 is rotated relative to the container 13, the shorter leg 45 of the J-shaped rod 41 functions as a hinge axle. When functioning as a hinge, the force exerted by the coil spring 51 acting against the cap 49 and the tubular socket 25 holds the shorter leg 45 in the second tubular socket 29.

FIG. 5 of the drawings shows four latch hinges 11 of this invention attached to a cover 15 of a container 13 to function as both latches and hinges. Depending on which latches 11 are released, the cover 15 can be opened by being pivoted about the other latches 11 or if all four latches are released, the cover can be removed in its entirety from the container 13. In any event, the latching portions 43 and 45 of the hinges cannot be lost because they will always be retained with the first plate 17 of the latch.

Although this specification has shown the latch hinge 1 arranged so that its first plate 17 is attached to a cover and its second plate 21 attached to a container, it should be understood and appreciated that this arrangement could be reversed or that the hinges could be attached to sides or other structural members of a container such as a hatch cover or door in a manner which will permit either hinged opening of such hatch cover or door or complete removal thereof. Therefore, the scope of this invention should be limited only by a liberal interpretation of the claims appended hereto.

I claim:

1. A hinge for removably attaching a cover member to a container member, said hinge including:

a first plate affixable to one of said members and a second plate affixable to the other of said members, a first tubular socket formed integrally with said first plate, a second tubular socket formed integrally with said second plate, said first and second tubular sockets being aligned when said first and second plates are fastened in alignment to said container and cover members, a J-shaped rod having a longer leg and a shorter leg joined by an integral bail, a cap formed on the end of said longer leg located away from said bail, said J-shaped rod being mounted on said first plate with said longer leg extending through said first tubular socket, a coil spring telescoped over a portion of said longer leg- of said J-shaped rod with said spring engaging said first tubular socket and said cap to bias said bail against said opposite side of said first tubular socket, said shorter leg being movable into and out of said second tubular socket to latch said plates together or to function as a hinge permitting rotation of one plate relative to said other plate.

2. The hinge of claim 1 in which said shorter leg of said J-shaped rod is longer than said second tubular socket.

3. The hinge of claim 1 in which said spring can be compressed sufficiently to permit said shorter leg to be slid out of said second tubular socket.

* * * * *